US006889774B2

(12) United States Patent
Multer et al.

(10) Patent No.: US 6,889,774 B2
(45) Date of Patent: May 10, 2005

(54) FIRE PROTECTION SPRINKLER SYSTEM FOR METAL BUILDINGS

(75) Inventors: Thomas L. Multer, Westminster, SC (US); Paul Sasser, Hartsdale, NY (US); Ricardo Goldberg, Harrison, NY (US)

(73) Assignee: The Reliable Automatic Sprinkler Co., Inc., Mount Vernon, NY (US)

( * ) Notice: Subject to any disclaimer, the term of this patent is extended or adjusted under 35 U.S.C. 154(b) by 391 days.

(21) Appl. No.: 10/085,563

(22) Filed: Feb. 27, 2002

(65) Prior Publication Data

US 2003/0160111 A1 Aug. 28, 2003

(51) Int. Cl.[7] ..... A62C 37/08
(52) U.S. Cl. ..... 169/37; 239/504; 239/518
(58) Field of Search ..... 169/37; 239/504, 239/498, 518, 521, 522, 523, 524, DIG. 1

(56) References Cited

U.S. PATENT DOCUMENTS

| | | | | |
|---|---|---|---|---|
| 783,826 | A | 2/1905 | Dinkel | |
| 2,046,169 | A | 6/1936 | Knight | |
| 2,101,694 | A | 12/1937 | Tyden | |
| RE24,353 | E | 9/1957 | Kromer | |
| 2,862,565 | A | 12/1958 | Dukes | |
| 3,146,823 | A * | 9/1964 | Loveland | 239/518 |
| 3,880,239 | A | 4/1975 | Vorkapich | |
| 4,074,862 | A | 2/1978 | Jardinier et al. | |
| 4,296,815 | A | 10/1981 | Mears | |
| 4,296,816 | A | 10/1981 | Fischer | |
| 4,580,729 | A | 4/1986 | Pounder | |
| 4,585,069 | A * | 4/1986 | Whitaker | 169/37 |
| 4,987,957 | A | 1/1991 | Galaszewski | |
| 5,180,103 | A | 1/1993 | Harrison, Jr. et al. | |
| 5,366,022 | A | 11/1994 | Meyer et al. | |
| 5,664,630 | A | 9/1997 | Meyer et al. | |
| 5,669,449 | A | 9/1997 | Polan et al. | |
| 5,722,599 | A | 3/1998 | Fries | |
| 5,727,737 | A | 3/1998 | Bosio et al. | |
| 5,810,263 | A | 9/1998 | Tramm | |

FOREIGN PATENT DOCUMENTS

| | | |
|---|---|---|
| DE | 2542559 | 3/1977 |
| GB | 1307095 | 2/1973 |
| GB | 2103481 | 2/1983 |
| GB | 2206043 | 12/1988 |

OTHER PUBLICATIONS

Central BVR Sidewall Model BVR 5.4 K–factor Fast Response Residential Horizontal Sidewall & Recessed Horizontal Sidewall Glass Bulb Automatic Sprinkler Product Information (3–01).

Central Attic Specific Application Attic Sprinklers™ Back to Back™, Single Directional™ and HIP™ Fast Response Glass Bulb or Fusible Link Automatic Sprinklers Product Information (3–01).

* cited by examiner

*Primary Examiner*—Dinh Q. Nguyen
(74) *Attorney, Agent, or Firm*—Baker Botts LLP

(57) ABSTRACT

A fire protection sprinkler system for metal buildings has horizontally oriented sprinkler heads mounted on water supply lines extending along each side of rafters supporting the roof of a metal building so as to provide protection for bays between adjacent rafters having a width up to 25 feet or more. The sprinkler heads have a vertical part facing an outlet in a sprinkler body and a hood-shaped part supported from the vertical part and having downwardly inclined side walls and a downwardly inclined front wall. The deflector arrangement is supported from the sprinkler body by a pair of frame arms which converge at a boss on which the vertical part is mounted and another deflector part having rearwardly inclined arms extending horizontally, downwardly at an angle and substantially vertically, is supported between the boss and the vertical part of the deflector.

17 Claims, 6 Drawing Sheets

FIRE PROTECTION SPRINKLER SYSTEM FOR METAL BUILDINGS

BACKGROUND OF THE INVENTION

This invention relates to sprinkler systems for protecting the contents of metal buildings against fires.

Conventional metal building fire protection systems have sprinklers mounted on pipes which are supported from purlins that extend between the roof support beams, or rafters, of the building. The rafters are spaced about 25 feet apart to form a plurality of bays and normally two or more sprinkler lines are supported from the purlins extending across the rafters at about 5-foot intervals over each bay. Because of the weight of the sprinkler lines and the water contained in them, the purlins, which have a Z-shaped cross-section, must be made strong enough to support the sprinkler lines as well as the roofing over the bay, which increases construction costs. In addition, since standard clamp-type hangers can not readily be installed on the purlins because of their Z-shape, it is necessary to drill or punch holes in the purlins for hanger installation, further increasing the installation costs.

The Meyer et al. U.S. Pat. No. 5,366,022 discloses extended coverage pendent and upright ceiling-mounted sprinklers for protecting areas up to 256 square feet per sprinkler and potentially up to 400 square feet per sprinkler.

The patent to Polan et al. U.S. Pat. No. 5,669,449 discloses sprinkler systems having pipes supported from the beams of a pitched roof with upright sprinklers spaced up to 20 feet apart having deflectors with horizontal central portions and downwardly inclined side portions to deflect upwardly directed water over an area of up to 225 square feet to be protected by each sprinkler.

The Mears U.S. Pat. No. 4,296,815, the Fischer U.S. Pat. No. 4,296,816, the Galaszewski U.S. Pat. No. 4,987,957, the Fries U.S. Pat. No. 5,722,599 and the Bosio et al. U.S. Pat. No. 5,727,737 disclose horizontal side wall sprinklers provided with deflectors having a vertical portion in line with the outlet orifice of the sprinkler and a generally horizontal deflector portion disposed above the vertical portion to distribute water over areas to be protected which extend laterally on one side of the location of the sprinkler.

The Tramm U.S. Pat. No. 5,810,263 discloses a horizontal sprinkler provided with a deflector having a vertical portion in line with the sprinkler orifice and a generally horizontal portion extending rearwardly from the vertical portion toward the sprinkler orifice and having downwardly inclined side portions to confine the water distributed from the sprinkler to a desired area laterally beneath the sprinkler.

SUMMARY OF THE INVENTION

It is an object of the present invention to provide a fire protection sprinkler system for the contents of metal buildings which overcomes disadvantages of the prior art.

Another object of the invention is to provide a sprinkler arrangement for installation in metal buildings having ceilings supported by rafters and purlins extending across bays between the rafters.

These and other objects of the invention are attained by mounting arrays of sprinklers along with their supply piping along the sides of each rafter in a building having a ceiling supported by rafters and purlins, each sprinkler being capable of extended coverage of up to 196 square feet so that it provides protection for an area of the bay between the rafters extending up to 14 feet or more from the rafter on which the sprinkler is mounted, thereby covering more than half the area of bays of 28 feet or less in width. Thus, by mounting sprinklers and supply piping on the sides of both rafters facing each bay, complete coverage of the area within the bay is assured without requiring stronger purlins.

In a preferred embodiment, the sprinklers are horizontally oriented sprinklers having a deflector with a generally vertical portion facing the sprinkler orifice and a hood-shaped portion above the generally vertical portion shaped so that the water emerging from the sprinkler orifice is directed generally across the adjacent half of the bay on the side of the rafter on which the sprinkler is mounted. Each sprinkler has a K factor of at least 11, preferably in a range from about 11 to about 25, and desirably at least about 14, and provides a density of at least about 0.2 gallons per minute per square foot of the covered area in the bay.

For this purpose the deflector preferably includes a generally vertical part horizontally in line with the sprinkler orifice having an opening above the sprinkler axis and a hood-shaped part disposed above and supported by the vertical part and having a generally horizontal roof portion with downwardly angled sidewall portions disposed on opposite sides of the sprinkler axis and a downwardly angled front wall portion disposed forwardly of the generally vertical part. In a preferred arrangement, the hood-shaped part is centrally supported by arms extending upwardly from opposite side edges of the generally vertical part and the generally vertical part has a vertical projection extending into the central region of the opening above the sprinkler axis and a lower portion below the sprinkler axis which is inclined forwardly away from the sprinkler orifice.

BRIEF DESCRIPTION OF THE DRAWINGS

Further objects and advantages of the invention will be apparent from a reading of the following description in conjunction with the accompanying drawings in which.

DESCRIPTION OF PREFERRED EMBODIMENTS

Figure 1:
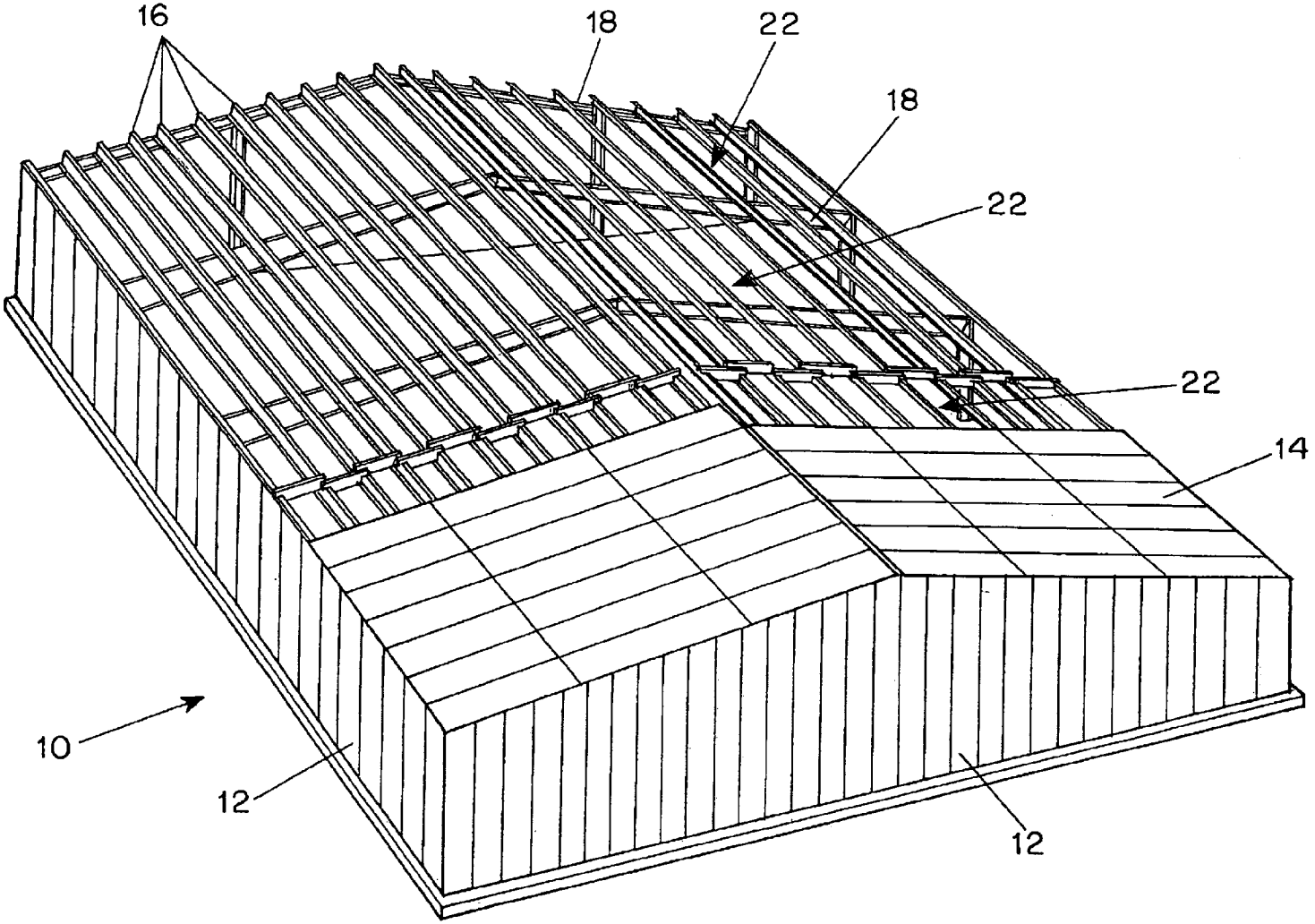
FIG. 1 is a schematic perspective view illustrating a metal building with its roof partially removed prior to installation of a sprinkler system according to the invention.

A typical metal building 10, illustrated in FIG. 1, in which a fire protection system in accordance with the invention may be installed, includes metal side walls 12 and a metal roof 14 supported by purlins 16 which are, in turn, mounted on rafters 18 extending across the width of the building and spaced at intervals of 25 or 28 feet, for example, leaving intervening bays 22. The purlins 16, which span the spacing between the rafters at approximately 5 foot intervals, have a Z-shape in cross-section and are designed with adequate strength to support the roof 14. If fire protection sprinklers and supply piping are suspended from the purlins, as is conventional practice, larger and stronger purlins must be provided, thereby increasing the cost of the building. Moreover, to suspend the supply piping for a fire protection sprinkler system from Z-shaped purlins, holes must be drilled or punched in the purlins to install the hangers for the piping, further adding to the cost of installation.

Figure 2:
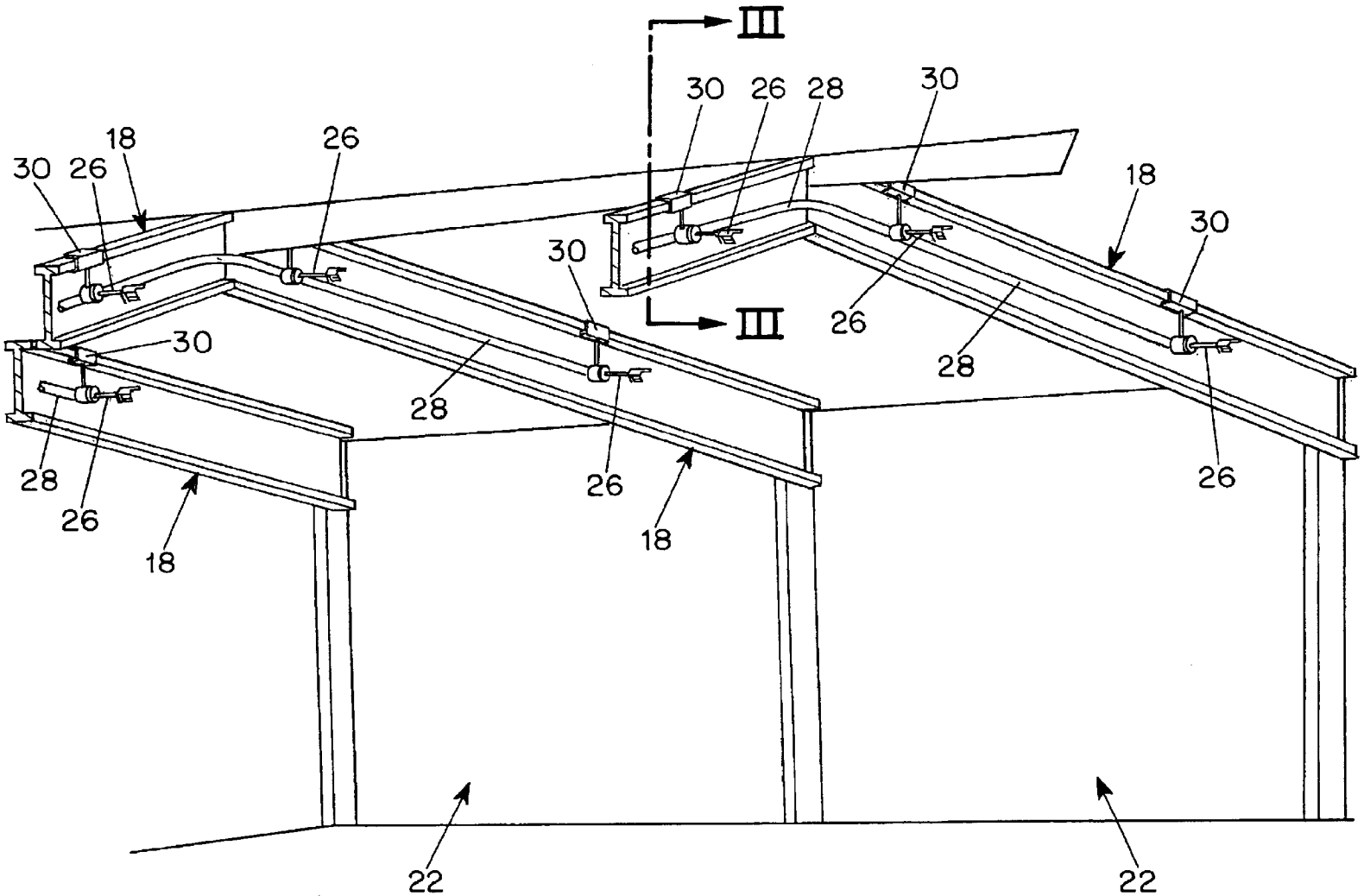
FIG. 2 is a fragmentary view of the building shown in FIG. 1 schematically illustrating a representative embodiment of a sprinkler system according to the invention as installed in the building.
Figure 3:
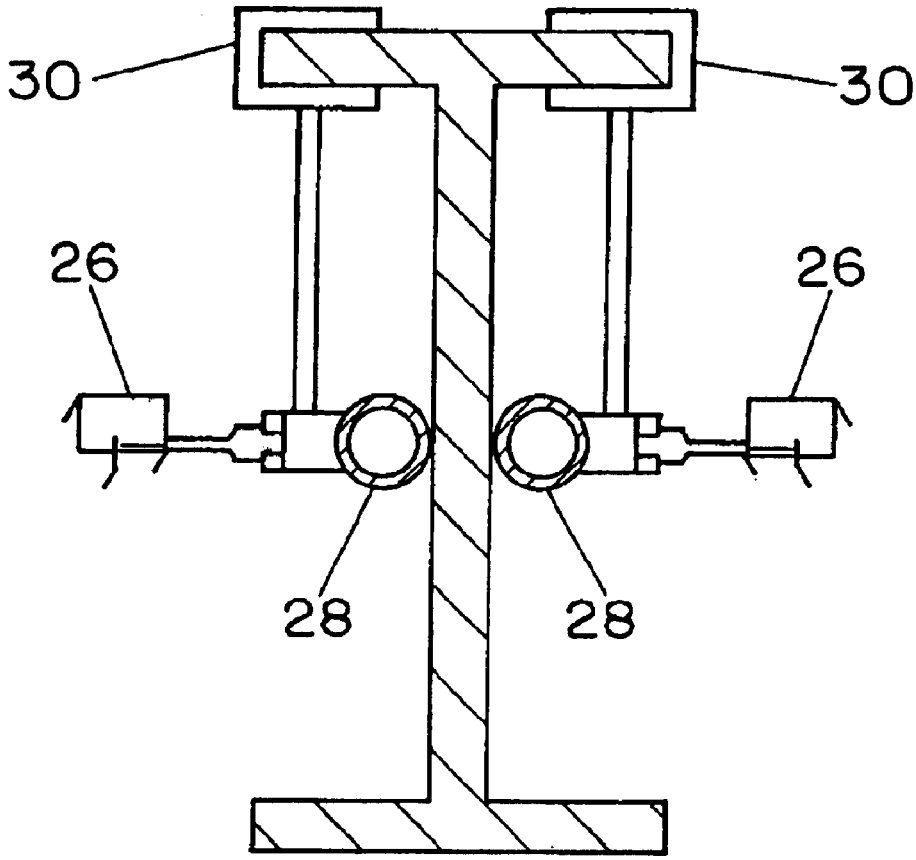
FIG. 3 is a sectional view taken on the line III—III of FIG. 2 and looking in the direction of the arrows.

In order to provide a fire protection system for such metal building structures in accordance with the invention, preferably for buildings about twenty to thirty feet high, an array of sprinklers 26 and supply piping 28 are installed on each side of each of the rafters 18, as shown in FIGS. 2 and 3, and each sprinkler 26 is designed and oriented to provide coverage for at least half of the distance between the rafters in the intervening bays 22. Since the rafters 18 are usually designed to support the weight of the supply piping and sprinklers in a conventional fire protection system supported from the purlins, no increase in the size and strength of the rafters is required so that the cost of the structure is not increased by the installation of a fire protection system in accordance with the invention. Furthermore, since the supply piping 28 supporting the sprinklers 26 on the rafters 18 can conveniently be mounted by conventional clamps 30, as best seen in FIG. 3, no special mounting arrangements are required.

Figure 4:
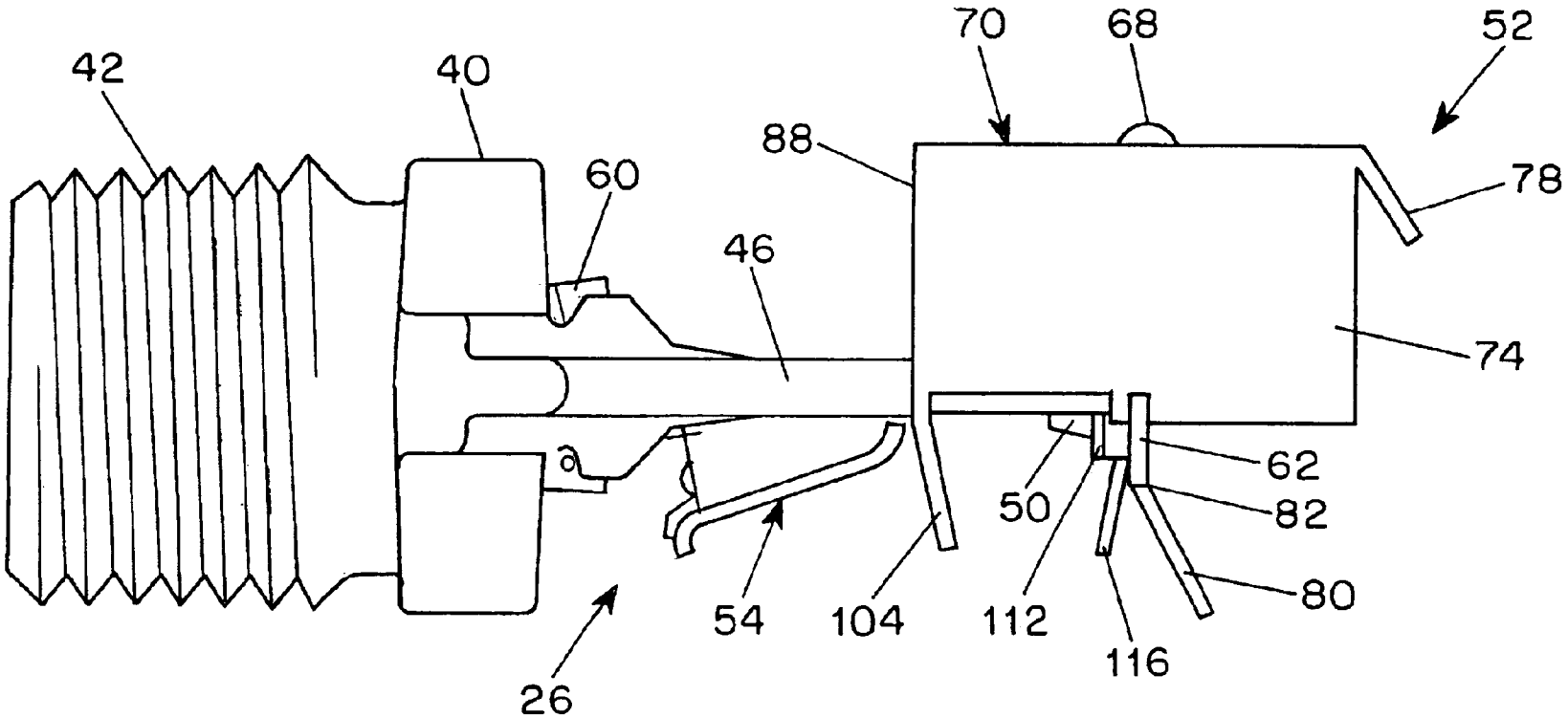
FIG. 4 is a side view of a representative embodiment of a horizontal sprinkler arrangement for use in the system shown in FIGS. 2 and 3.
Figure 5:
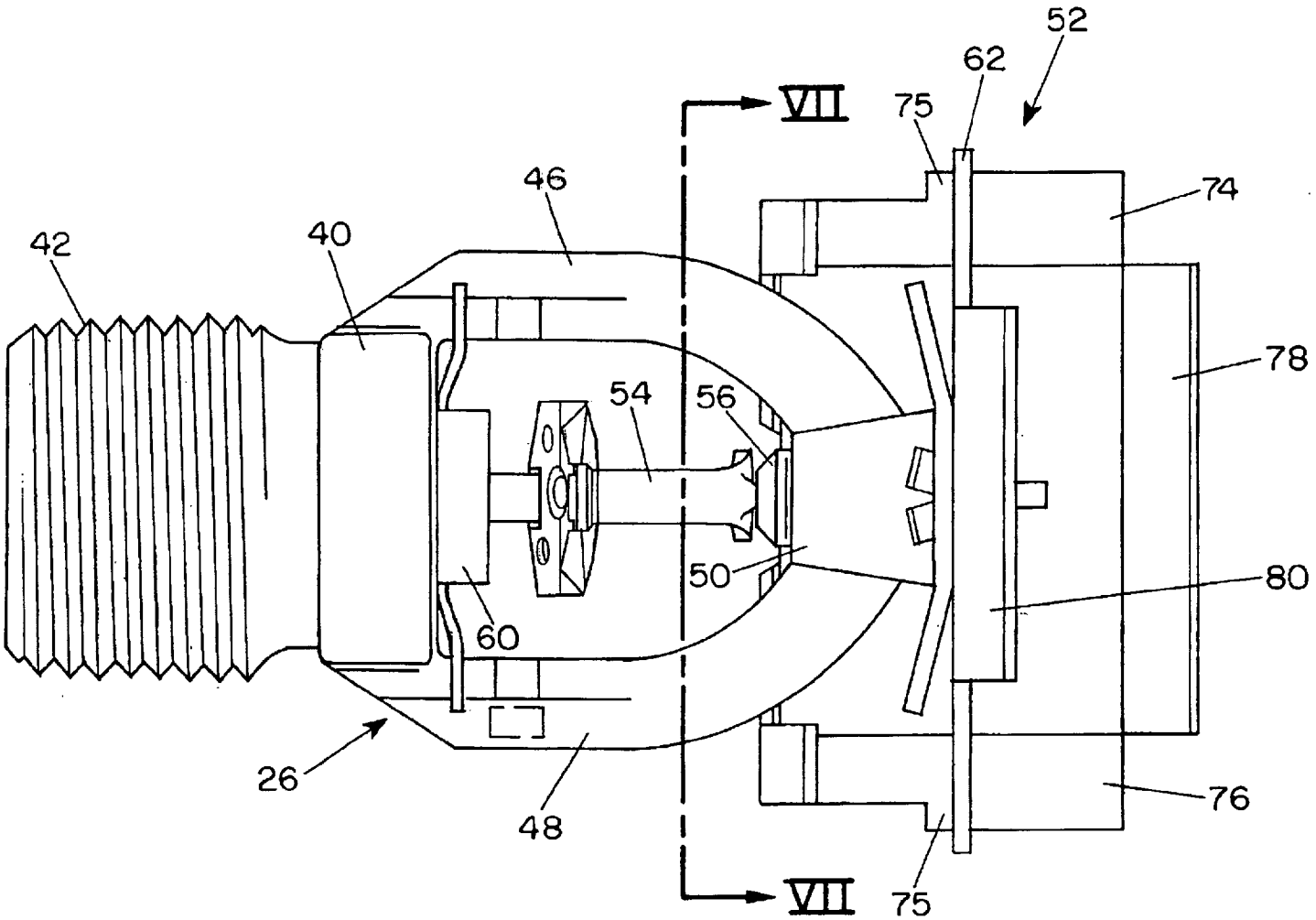
FIG. 5 is a bottom view of the sprinkler arrangement shown in FIG. 4.
Figure 6:
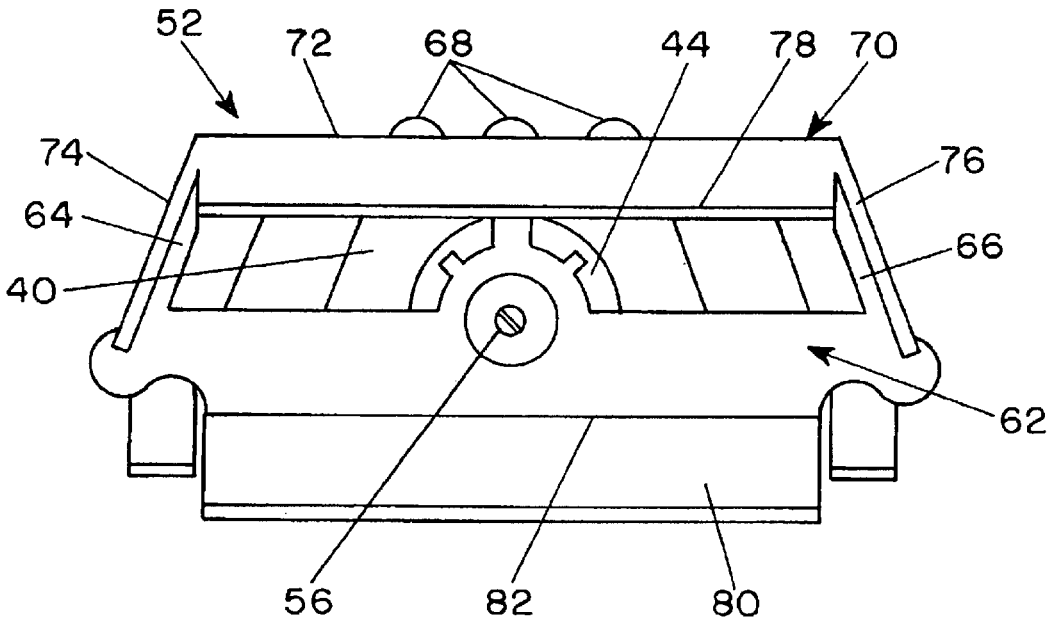
FIG. 6 is a front view of the sprinkler arrangement shown in FIGS. 4 and 5.

The sprinklers 26 used in the system of the invention are preferably horizontal sprinklers designed to assure an actual delivered density (ADD) in the adjacent portion of the bay 22 adequate to satisfy light hazard and ordinary hazard applications and, if appropriate, extra hazard and storage applications. A representative embodiment of a sprinkler 26 for this purpose in accordance with the invention is shown in FIGS. 4–7. As best seen in FIGS. 4 and 5, the sprinkler 26 has a sprinkler body 40 having a threaded end 42 adapted to be connected to supply piping 28 through which water is supplied to the sprinklers and formed and the usual manner with a central passage having an orifice 44, shown in FIG. 6, through which water is supplied when the sprinkler is actuated. The size of the orifice 44 is selected to provide a K factor in a range from about 11 to about 25 and preferably at least about 14.

The sprinkler body 40 is formed at its other end with a frame consisting of two spaced arms 46 and 48 which are joined in a boss 50 on the sprinkler axis to support a deflector arrangement 52. The boss 50 has a surface which diverges outwardly from the sprinkler axis in the direction away from the sprinkler body 40 to assist in distributing water emerging from the orifice. A thermally responsive element 54, such as a soldered link, extends from the end of a screw 56 passing through the boss 50 to a plug 60 which normally closes the passage through the sprinkler body 40 until it is released when the thermally responsive element 54 is heated to a selected elevated temperature. Preferably the thermally responsive element 54 is a fast response device with a response time index (RTI) of less than 50.

Optimum distribution of the water issuing from the orifice 44 over the area to be protected is provided by the deflector arrangement 52 which includes a vertical part 62 affixed to the boss 50 and having at its opposite sides two support arms 64 and 66. A hood-shaped part 70 of the deflector arrangement 52 is mounted on the support arms 64 and 66 and has a horizontal top wall 72, two downwardly angled side walls 74 and 76 on opposite sides, and a downwardly inclined front wall 78. The side walls 74 and 76 extend at an angle from the vertical in a range from about 15° to about 35°, and preferably about 25°, and the front wall 78 extends at an angle to the vertical in a range from about 40° to 60°, preferably about 40° to 45° and desirably 42°. As shown in FIG. 5, the side walls 74 and 76 intersect the ends of the vertical part 62, forming tabs 75 behind the vertical part to provide good lateral distribution.

The support arms are joined at their upper ends by a cross piece within the hood-shaped part having three tabs 68 which extend through the top wall 72 approximately centrally of the axial length of the hood and are mushroomed over to secure the hood-shaped part 70 to the support arms 64 and 66. The vertical part 62 also includes a lower part 80 which is bent forwardly away from the orifice 44 at an angle in the range from about 20° to about 40°, preferably about 30°, to the vertical along a horizontal line 82 located approximately at the level of the lower ends of the arms 64 and 66 supporting the hood-shaped part 70.

Figure 7:
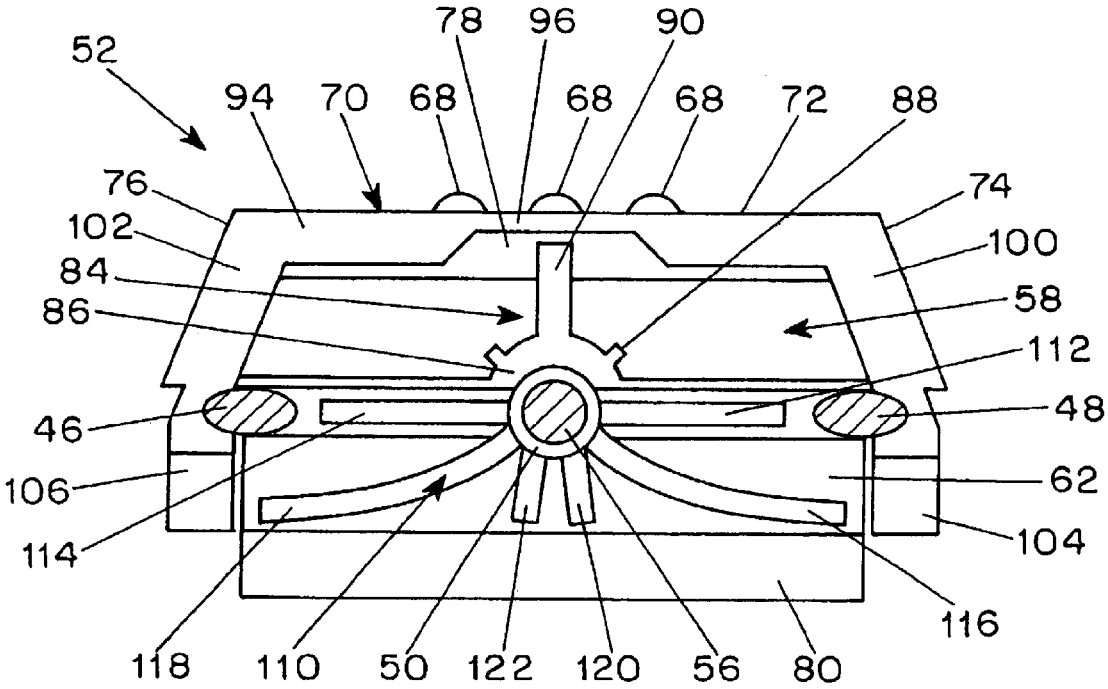
FIG. 7 is a cross-sectional view taken on the line VII—VII of FIG. 5 showing the portion of the sprinkler deflector which faces the sprinkler orifice.

As best seen in FIG. 7 the opening 58 formed between the support arms 64 and 66 in the upper region of the vertical part 62 of the deflector arrangement 52 is divided by a centrally located upwardly projecting part 84 having a semi-circular lower portion 86, two small projections 88 extending at opposite angles of about 30° to the horizontal, and a larger vertical projection 90 extending toward but not intersecting the cross piece supporting the mushroomed tabs 68 which extend through the top wall 72 of the hood-shaped part 70. In addition, the hood-shaped part 70 has, as seen in FIG. 7, a rear wall portion 94 extending downwardly from the top wall 72 with a central part 96 of reduced width spanning the upper end of the upward projection 90 of the vertical part 62. The downwardly inclined side portions 74 and 76 of the hood-shaped part are joined to inwardly extending rear wall portions 100 and 102, respectively, having lower ends 104 and 106 which are inclined forwardly at an angle to the vertical in a range from about 20° to about 45°, preferably about 20° to 25°, and desirably 22°.

In addition, a deflector rear part 110 mounted between the boss 50 and the vertical part 62 is formed with two horizontally extending arms 112 and 114, two downwardly angled arms 116 and 118 extending to a location adjacent to the edges of the lower portion of the vertical part 62 and two further arms 120 and 122 extending downwardly on opposite sides of the sprinkler axis. Each of the arms 112, 114, 116, 118, 120 and 122 is inclined rearwardly toward the orifice 44 at an angle to the vertical in the range from about 10° to about 30°, preferably about 20°.

With this arrangement, sprinklers 26 mounted on rafters 18 in the manner shown in FIG. 2 are capable of protecting goods stored in metal buildings having bays about 25 to 28 feet wide without requiring any sprinklers or supply lines to be supported from purlins spanning the bay, thereby eliminating the need for stronger purlins.

Although the invention has been described herein with reference to specific embodiments, many modifications and variations therein will readily occur to those skilled in the art. Accordingly, all such variations and modifications are included within the intended scope of the invention.

We claim:

1. A horizontal sprinkler head for use in fire protection sprinkler systems for metal buildings comprising:

a sprinkler body adapted to be connected to a water supply line and having a passage with an orifice;

a deflector arrangement supported from the sprinkler body in horizontally spaced relation to the orifice;

the deflector arrangement including a vertical part disposed in line with the sprinkler orifice and a hood-shaped part located above and supported from the vertical part;

the hood-shaped part including a horizontal roof portion, two side wall portions extending downwardly from opposite sides of the roof portion at angles to the vertical, and a front wall portion extending downwardly from the front of the roof portion at an angle to the vertical; and the vertical part including a lower portion inclined at an angle to the vertical in the direction away from the sprinkler orifice, a horizontally extending opening above the sprinkler axis between spaced arm portions supporting the hood-shaped part, and a vertical projection extending upwardly into the horizontally extending opening.

2. A sprinkler arrangement according to claim 1 wherein the side wall portions extend at an angle to the vertical in a range from about 15° to 35°.

3. A sprinkler arrangement according to claim 2 wherein the side wall portions extend at an angle to the vertical of about 25°.

4. A sprinkler arrangement according to claim 1 wherein the front wall portion extends at an angle to the vertical in a range from about 40° to 60°.

5. A sprinkler arrangement according to claim 4 wherein the front wall portion extends at an angle to the vertical of about 42°.

6. A sprinkler arrangement according to claim 1 wherein the lower portion of the vertical part extends at an angle to the vertical in a range from about 20° to about 40°.

7. A sprinkler arrangement according to claim 6 wherein the lower portion of the vertical part extends at an angle to the vertical of about 30°.

8. A sprinkler arrangement according to claim 1 wherein the hood-shaped part includes a rear wall portion extending downwardly from the rear of the roof portion and having surface facing the orifice.

9. A sprinkler arrangement according to claim 1 wherein the ends of the side walls of the hood-shaped part facing the sprinkler orifice have inward projections with forwardly inclined lower portions.

10. A sprinkler arrangement according to claim 9 wherein the lower portions of the inward projections are inclined away from the orifice at an angle to the vertical in a range from about 20° to about 45°.

11. A sprinkler arrangement according to claim 10 wherein the lower portion of the inward projections are inclined away from the orifice at an angle to the vertical of about 22°.

12. A sprinkler arrangement according to claim 1 wherein the deflector arrangement includes a further part mounted on the side of the vertical part facing the orifice and having arms extending horizontally, arms extending downwardly and arms extending at an angle between the horizontal arms and the arms extending downwardly, each of the arms being inclined at an angle to the vertical toward the orifice.

13. A sprinkler arrangement according to claim 12 wherein the arms extend at an angle to the vertical in a range from about 10° to about 30°.

14. A sprinkler arrangement according to claim 13 wherein the arms extend at an angle to the vertical of about 20°.

15. A sprinkler arrangement according to claim 1 including a pair of deflector support arms extending from the sprinkler body and joined on the sprinkler axis at a boss supporting the vertical part of the deflector arrangement.

16. A sprinkler arrangement according to claim 1 having a K factor in a range from about 11 to about 25.

17. A sprinkler arrangement according to claim 16 having a K factor of at least about 14.

* * * * *